US007687699B2

(12) United States Patent
Briggs et al.

(10) Patent No.: US 7,687,699 B2
(45) Date of Patent: Mar. 30, 2010

(54) DRUM STICK HOLDER

(75) Inventors: Stephen William Briggs, Lymington (GB); John Martin Vecpuisis, Lymington (GB)

(73) Assignee: Silclear Limited (GB)

( * ) Notice: Subject to any disclaimer, the term of this patent is extended or adjusted under 35 U.S.C. 154(b) by 731 days.

(21) Appl. No.: 10/598,972

(22) PCT Filed: Mar. 17, 2005

(86) PCT No.: PCT/GB2005/001115

§ 371 (c)(1),
(2), (4) Date: Sep. 15, 2006

(87) PCT Pub. No.: WO2005/091270

PCT Pub. Date: Sep. 29, 2005

(65) Prior Publication Data

US 2007/0144331 A1 Jun. 28, 2007

(30) Foreign Application Priority Data

Mar. 17, 2004 (GB) ..... 0406108.1

(51) Int. Cl.
*G10D 13/02* (2006.01)

(52) U.S. Cl. ..... 84/422.4; 84/421; 84/329

(58) Field of Classification Search ..... 84/329, 84/422.4, 421
See application file for complete search history.

(56) References Cited

U.S. PATENT DOCUMENTS 2,744,348 A * 5/1956 Smith ..... 2/94
2,805,814 A * 9/1957 Calasibetta et al. ..... 383/38
3,181,751 A * 5/1965 Wilson ..... 383/39
3,350,810 A * 11/1967 Warner et al. ..... 43/57.1
3,722,350 A * 3/1973 Cordes ..... 84/422.4
3,749,233 A * 7/1973 McCormick, Jr. ..... 206/373
4,101,025 A * 7/1978 Jordan ..... 206/377
4,246,826 A * 1/1981 Warrick et al. ..... 84/422.4
D264,522 S * 5/1982 Welborn ..... D3/204
4,385,544 A * 5/1983 Heiskell ..... 84/422.4
4,392,678 A * 7/1983 Adamczyk ..... 285/256
4,531,443 A * 7/1985 Gillis, Jr. ..... 84/329
4,696,403 A * 9/1987 Hoover ..... 383/37

(Continued)

FOREIGN PATENT DOCUMENTS

DE 44141013 10/1995

(Continued)

OTHER PUBLICATIONS

Search Report, GB0406108.1, UK Patent Office Jul. 27, 2004.

(Continued)

*Primary Examiner*—Jeffrey Donels
*Assistant Examiner*—Robert W Horn
(74) *Attorney, Agent, or Firm*—Bourque and Associates, PA

(57) ABSTRACT

The present invention relates to a holder for drum sticks, drum brushes, mallets and other such percussion implements for playing percussion instruments. The drum stick holder (1), comprising a plurality of substantially parallel tubular sleeves (2), each sleeve being joined to at least one adjacent sleeve and having an entrance (7, 9) with dimensions suitable for receiving just one drum stick, wherein each sleeve (2) is formed from an elastomeric material so that each sleeve may grip a drum stick inserted into the sleeve (2).

20 Claims, 5 Drawing Sheets

U.S. PATENT DOCUMENTS

| | | | | | |
|---|---|---|---|---|---|
| D292,849 | S | * | 11/1987 | Dickie et al. | D3/224 |
| 4,827,658 | A | * | 5/1989 | Wolniak | 43/54.1 |
| 4,970,934 | A | * | 11/1990 | Reed et al. | 84/422.4 |
| D319,836 | S | * | 9/1991 | Clouse et al. | D17/122 |
| 5,095,645 | A | * | 3/1992 | Borawski | 43/57.1 |
| D325,952 | S | * | 5/1992 | Moore | D22/108 |
| 5,117,724 | A | | 6/1992 | Gardner | |
| 5,139,143 | A | * | 8/1992 | Pond | 206/373 |
| 5,199,621 | A | * | 4/1993 | McLennan | 224/673 |
| D342,155 | S | * | 12/1993 | Borawski | D3/260 |
| 5,302,302 | A | * | 4/1994 | Shelley et al. | 224/148.4 |
| 5,311,698 | A | * | 5/1994 | Plost | 43/54.1 |
| D348,564 | S | * | 7/1994 | Kalkhof | D3/284 |
| 5,370,288 | A | * | 12/1994 | Field | 224/223 |
| 5,377,833 | A | * | 1/1995 | Ranger | 206/430 |
| D363,818 | S | * | 11/1995 | Booth et al. | D3/254 |
| D364,520 | S | * | 11/1995 | Matthews | D6/514 |
| 5,522,300 | A | * | 6/1996 | Cheatwood | 84/453 |
| 5,551,660 | A | * | 9/1996 | Leduchowski | 248/276.1 |
| D378,633 | S | * | 4/1997 | Granito | D3/228 |
| 5,696,339 | A | * | 12/1997 | Brennan | 84/422.4 |
| D389,356 | S | * | 1/1998 | Calabrese | D6/569 |
| D390,457 | S | * | 2/1998 | Hoska et al. | D9/707 |
| 5,839,633 | A | * | 11/1998 | Fisher | 224/675 |
| D410,331 | S | * | 6/1999 | Hamilton | D3/221 |
| 6,150,595 | A | * | 11/2000 | Vaglica | 84/421 |
| D436,616 | S | * | 1/2001 | Kaiser | D17/22 |
| D445,564 | S | * | 7/2001 | Brookhouse | D3/206 |
| 6,422,753 | B1 | * | 7/2002 | Thomas | 383/209 |
| 6,563,036 | B1 | | 5/2003 | Biasini | |
| 6,658,786 | B1 | * | 12/2003 | Williams | 43/54.1 |
| 6,905,143 | B2 | * | 6/2005 | Klinger et al. | 285/140.1 |
| 7,060,040 | B2 | * | 6/2006 | Farmer | 600/573 |
| 7,117,541 | B2 | * | 10/2006 | Hozack | 2/161.5 |
| D555,461 | S | * | 11/2007 | Tincher | D8/370 |
| 7,305,793 | B1 | * | 12/2007 | Macdonald | 43/54.1 |
| 7,389,899 | B2 | * | 6/2008 | Johnson | 224/675 |
| D581,807 | S | * | 12/2008 | Abbas et al. | D9/707 |
| 7,601,903 | B1 | * | 10/2009 | Monk | 84/422.4 |
| 2003/0005812 | A1 | * | 1/2003 | Geyer et al. | 84/422.4 |
| 2003/0209129 | A1 | * | 11/2003 | Citron et al. | 84/422.4 |
| 2005/0245899 | A1 | * | 11/2005 | Swisher | 604/533 |
| 2005/0268772 | A1 | * | 12/2005 | Schaff | 84/421 |
| 2007/0125675 | A1 | * | 6/2007 | Booker et al. | 206/438 |
| 2007/0144331 | A1 | * | 6/2007 | Briggs et al. | 84/422.1 |

FOREIGN PATENT DOCUMENTS

| | | |
|---|---|---|
| DE | 29612315 | 9/1996 |
| GB | 1249220 | 10/1971 |

OTHER PUBLICATIONS

International Search Report, PCT/GB2005/001115, European Patent Office Jun. 15, 2005.
Vater Percussion, Single Pair Stick Holder, Product Sheet.

* cited by examiner

DRUM STICK HOLDER

BACKGROUND a. Field of the Invention

The present invention relates to a holder for drum sticks, drum brushes, mallets and other such percussion implements for playing percussion instruments for example drums, xylophones, cymbals, bells, etc., all of which will for convenience only be referred to herein simply as "drums" or a "drum kit".

b. Related Art

When a drummer is playing a drum or a drum kit, it sometimes happens that the drummer drops a drum stick, or wishes to switch to a different drum stick. The drummer may also wish to use a drum brush or mallet, and all such percussion implements used to play drums, bells, cymbals and other percussion instruments are for convenience simply referred to throughout this document as "drum sticks".

A problem therefore arises in how a drummer may quickly and easily get a hold of a replacement drum stick or a different drum stick.

It is known to provide a drum stick holder in the form of a cup which may, for example, be attached to the leg of a drum stand. The cup is normally moulded in a rigid plastic material, and may hold 10 or more drum sticks. A problem with this arrangement is that it may be difficult to select the correct drum stick quickly if there is more than one type of drum stick in the cup, or if the drum sticks tend to clump together.

A solution to this problem is to provide a number of clips formed in a resilient plastic material which may, for example, be affixed directly to the side of a drum. Each clip has a pair of flexible arcuate arms that project away from the body of the drum and which extend at least 180° around the circumference of a circle. A drum stick may then be snapped into the opening. Although this arrangement maintains the relative orientations and arrangement of a number of drum sticks, it may still be difficult to get hold of a drum stick as the drum stick will normally be extending parallel with a cylindrical body of the drum on which the clips are affixed.

Furthermore, in all these prior art arrangements removing a drum stick from its holder or reintroducing a drum stick to its holder often creates an audible noise. This is particularly inconvenient in a recording studio.

SUMMARY OF THE INVENTION

It is an object of the present invention to provide a more convenient holder for a drum stick.

Accordingly, the invention provides a drum stick holder, comprising a plurality of substantially parallel tubular sleeves, each sleeve being joined to at least one adjacent sleeve and having an entrance with dimensions suitable for receiving just one drum stick, wherein each sleeve is formed from an integral tube of elastomeric material that extends fully around a longitudinal axis of the sleeve so that each sleeve may hold a drum stick inserted into the sleeve.

The drum stick holder may comprise additionally a mount for mounting the holder to a drum kit, the arrangement being such that each sleeve is supported by the mount.

In a preferred embodiment of the invention, each of the sleeves has a longitudinal axis, and each of these axes lies in a common plane that extends through each sleeve. Each sleeve may be joined to an adjacent sleeve by means of a web of elastomeric material. Preferably, the or each web of material lies in the plane in which the longitudinal axes of the sleeve lie.

The drum stick holder according to the invention provides a rugged and yet compact form of drum stick holder, which can be positioned as required either on legs, on a main body or on any other part of a percussion instrument or any other drum hardware that can be used with percussion instruments, or be provided with its own stand. Because the sleeves may be parallel and lie in a plane, the holder need not take up much room. The mount can also be arranged so that the holder is positioned close to an instrument, but with the drum sticks either spaced or angled with respect to a body of a percussion instrument such that a percussionist may readily get hold of the drum sticks in the holder.

Because each sleeve is formed from an elastomeric material so that each sleeve may either hold or grip a drum stick inserted into the sleeve, it is not always necessary that the sleeve be closed at one end to retain a drum stick. Therefore, at least one of the sleeves may be open at both ends. This can help to simplify manufacture of the holder, as it is easier to mould or to extrude a sleeve which is open at both ends. In one embodiment of the invention, all of the sleeves are open at both ends.

Leaving at least one of the sleeves open at both ends may also facilitate assembly of the holder. For example, the mount may include at least one projection which locates in at least one corresponding sleeve in order to secure the mount to the sleeves.

The holder may, however, comprise one or more plugs that may be removably inserted into one or more corresponding sleeves to close off one end of said sleeve(s) . Such a closed sleeve may then be used to help retain small items or narrow diameter drum sticks that would otherwise fall but of the bottom of the open sleeve. A closed sleeve may also be used in conjunction with a looser grip when the grip of the sleeve would otherwise make quick removal difficult. In this case, the drum stick may be supported by the plug which closes the sleeve rather that by the internal walls of the sleeve.

One or more of the sleeves may be tapered internally to aid insertion of a drum stick into the sleeve and to grip better the drum stick once inserted into the sleeve. However, it will generally be preferable if the inner surfaces of the sleeve are non-tapering in order to avoid jamming of a drum stick within the sleeve.

Each sleeve has inner and outer walls which are coaxial with a longitudinal axis and which extend fully around the longitudinal axis of the sleeve.

Optionally, a tear strip may separate at least two adjacent sleeves so that at least one sleeve may be torn from the drum stick holder to reduce the number of sleeves. A user may then be able to customise the capacity of the holder.

The sleeve will have an open end for receiving a drum stick. When there are at least three sleeves, then these open ends may be arranged such that each of the open ends are in line with all the other open ends.

In an alternative embodiment of the invention, the or each sleeve has an open end for receiving an end of a drum stick, and at least one middle sleeve projects forwards of adjacent outermore sleeves relative to an insertion direction for drum sticks. Preferably, the open ends of these sleeves are arranged in a V-pattern. or an inverted V-pattern. This greatly facilitates the tactile or visual identification of a desired one of the drum sticks, and when fitted in certain positions on a drum kit can facilitate quick removal of the drum stick.

BRIEF DESCRIPTION OF THE DRAWINGS

The invention will now be further described, by way of example only, and with reference to the accompanying drawings, in which.

DETAILED DESCRIPTION

Figure 1:
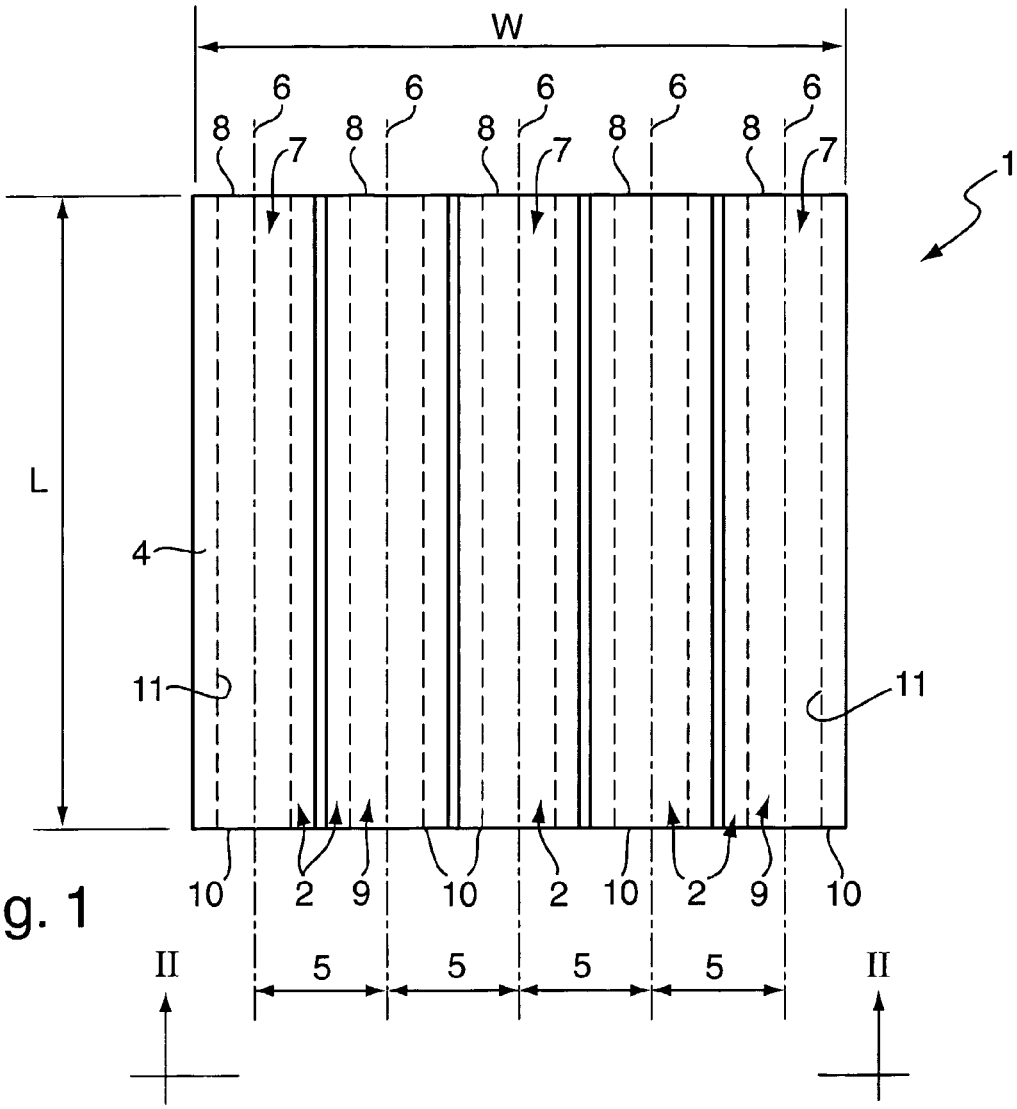
FIG. 1 is a plan view of a first embodiment of a drum stick holder according to a first embodiment of the invention, having five parallel tubular sleeves of equal length, formed in an elastomeric material.

FIG. 1 is a plan view of a first embodiment of a drum stick holder 1 according to the invention. The holder 1 has five parallel tubular sleeves 2 of equal length, formed in a flexible elastomeric material, for example a high grade silicone. Each sleeve is formed from an integral tube, in the sense that there are no gaps around the radius or circumference of each sleeve 2, so that the walls of each sleeve extend continuously around an axis 6 of each sleeve.

Each of the sleeves 2 has a cylindrical body 4 with an annular cross section which extends along the axis 6 between a first annular end face 8 and a second annular end face 10 of the sleeve 2. Each of the longitudinal axes 6 is parallel. Each end face 8,10 extends in a plane which is perpendicular to the axes 6, and which surrounds circular entrances 7, 9 to a cylindrical channel 11 that extends fully along the axis 6 of each sleeve 2.

Figure 2:
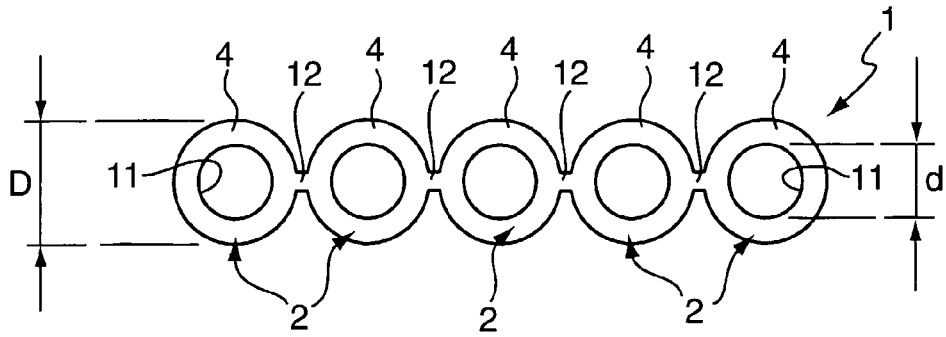
FIG. 2 is an end view of the drum stick holder, along line II-II of FIG. 1.

With reference now also to FIG. 2, each sleeve has a length L, which may be between about 40 mm and about 250 mm, but which in the first preferred embodiment is about 100 mm. Each sleeve also has an outer diameter D which may be between about 20 mm and about 30 mm, but which in the first preferred embodiment 1 is 24 mm. The inner diameter d may be chosen to be between about 5 mm and 15 mm less than the outer diameter D, and in the first preferred embodiment the inner diameter is 14 mm.

Each of the sleeves 2 is joined to at least one adjacent sleeve 2 by a planar web 12 which is integral with the adjacent sleeves 2. Each of the webs 12 is co-planar with the other webs, and lies in a plane that encompasses the longitudinal axes 6.

In the illustrated embodiments, each web 12 is 2 mm wide and 3 mm thick. The resultant centre-to-centre spacing S of the sleeve axes 6 is 26 mm.

The drum stick holder is integrally moulded, for example being formed by extrusion of an elastomeric material, for example a silicone material, which may be a blend of silicones that provide a desired degree of flexibility and resilience. Any other suitable moulding techniques may be used, for example injection moulding or compression moulding.

In use, the drum stick holder may be secured to a percussion instrument, or a separate stand, in a number of different ways. One way of securing the holder is to use adhesive tape (not shown) which may be applied over one side of the sleeves 2. The webs 12 provide significant flexibility and act as hinges so that the drum stick holder 1 can conform to a surface, particularly a cylindrical surface, of a percussion instrument.

Another way in which the drum stick holder 1 can be secured is by wedging the holder in a suitable gap, for example underneath a strap or between parallel members of a percussion stand or support. Again, the flexibility and resilience provided by the elastomeric material facilitates such a way of securing the drum stick holder 1.

Figure 4:
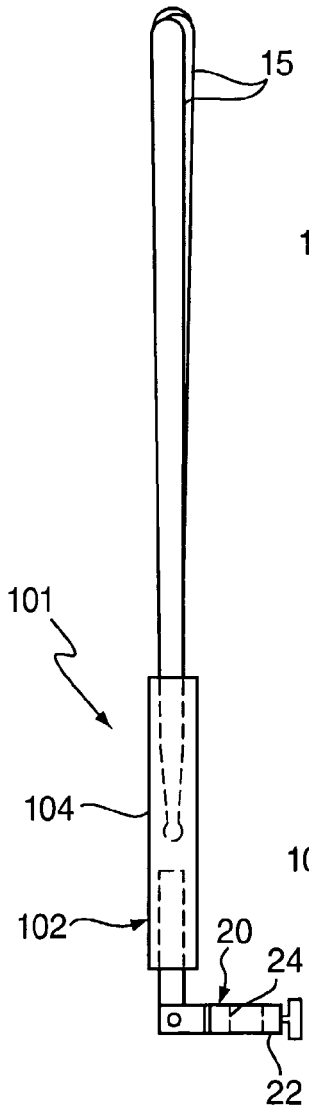
FIG. 4 is a side view of the drum stick holder of FIG. 3.
Figure 3:
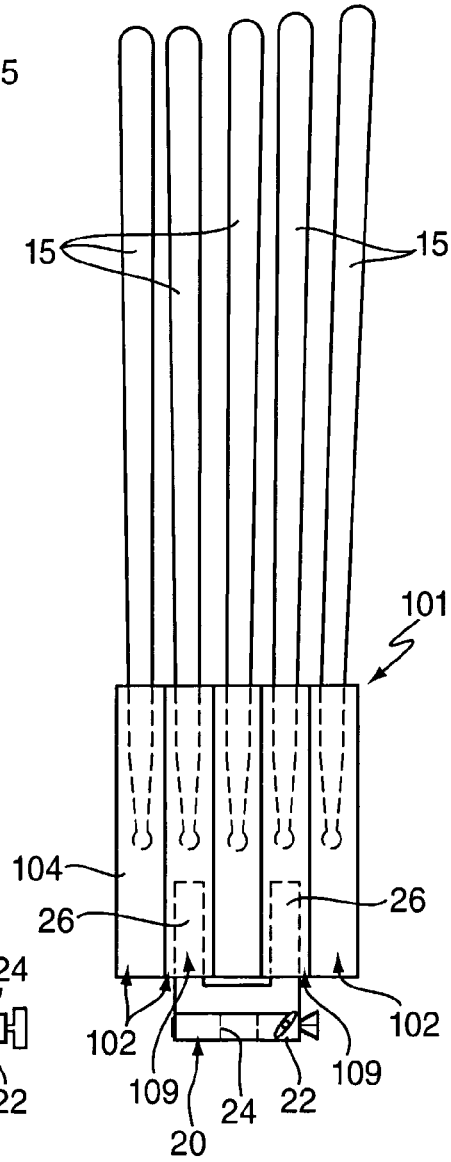
FIG. 3 is a plan view of the drum stick holder according to a second embodiment of the invention shown being used to hold five drum sticks, similar to the holder of FIG. 1 but comprising additionally a mount for supporting the holder.
Figure 6:
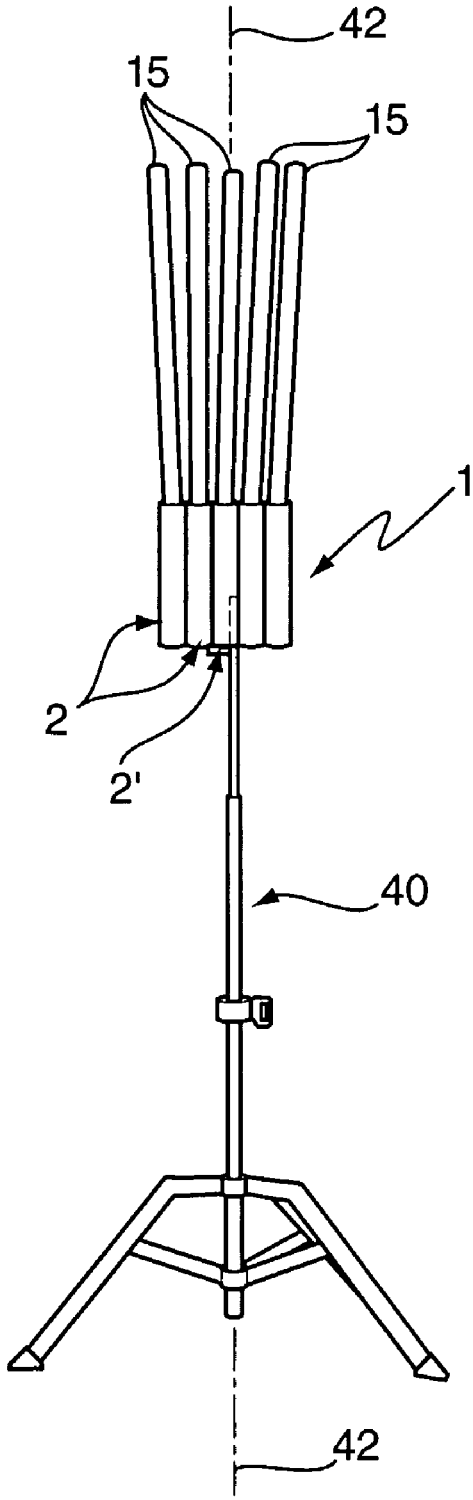
FIG. 6 is a perspective view of the drum stick holder of FIG. 1, being used to hold five drum sticks, and being mounted atop a dedicated stand which engages with a central sleeve.

Once the drum stick holder is secured, thin ends of percussion implements, such as sticks and mallets 15 , may as shown in FIGS. 3, 4 and 6, be inserted partially into one of the entrances 7, 9 until securely engaged by the channel 11 inside the sleeve 2. In this regard, it is to be appreciated that the inner diameter d of the sleeves may be selected to be about 1 mm less than the expected lateral dimensions of the drum stick 15 so inserted, so that the channel is expanded slightly upon insertion of the drum stick 15 to provide a snug fit. Alternatively, the inner diameter d of the sleeves may be selected to be about 0 mm to 0.5 mm less than the expected lateral dimensions of the drum stick 15 so inserted, so that the drum stick is merely held and not loose in the holder, rather than being securely gripped. Again, the particular properties of the elastomeric material and the thickness of the body 4 of the sleeve may be selected to give a desired compliance so that a drum stick 15 may be readily inserted and removed, yet remain securely engaged in the channel 11 otherwise.

It should also be appreciated that although each channel 11 is shown as having the same inner diameter d, the sleeves 2 may be formed with differing internal diameters d so that the drum stick holder 1 may accommodate a variety of different sized drum sticks 15.

FIGS. 3 and 4 show a second embodiment of a drum stick holder 101 according to the invention, in which features similar to those of the first embodiment 1 are indicated by reference numerals incremented by 100. The second embodiment of the drum stick holder 101 differs from the first embodiment 1 only in that the drum stick holder includes a mount 20 for connecting the drum stick holder 1 to a support or stand (not shown). The mount 20 includes a clamp 22 which surrounds a cylindrical aperture 24 for receiving a tubular feature, which may be a support for a percussion instrument (not shown).

The mount 20 is secured to the sleeves 2 by means of one finger 26, or even two or more fingers 26 which are inserted into free open ends 109 of at least one sleeve 2. The fingers are sized so that these expand the corresponding sleeves 2, which then grip the fingers 26 to secure the support to the sleeves 2. The mount 20 may, however, be removed from the sleeves 2, or repositioned so that the fingers 26 engage with different sleeves 2, as desired by a user of the holder 101.

Figure 5:
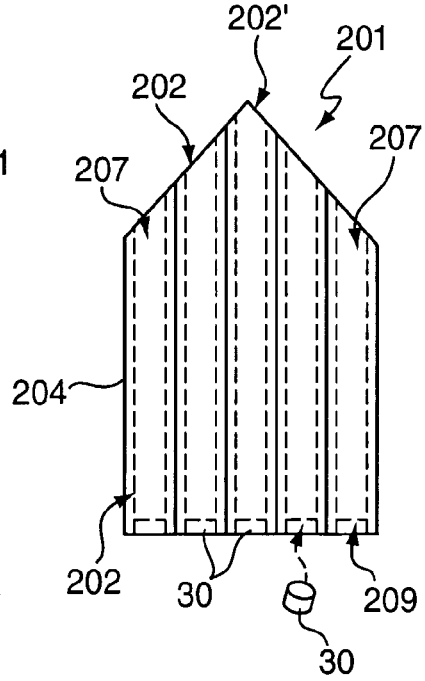
FIG. 5 is a plan view of a drum stick holder according to a third embodiment of the invention, having five parallel tubular sleeves of varying length, formed in an elastomeric material.

FIG. 5 is a plan view of a drum stick holder according to a third embodiment of the invention 201 formed in an elastomeric material. Features similar to those of the first embodiment 1 are indicated by reference numerals incremented by 200. The third embodiment of the drum stick holder 201 differs from the first embodiment 1 in two ways. First, the holder 201 has five parallel tubular sleeves 202 of varying length. Second, a number of cylindrical plugs 30 are provided which may be inserted into open ends 209 of the sleeves 202 in order to close off an open end. This may be desirable if the holder is to be used to hold a narrow diameter drum stick which might otherwise fall through the open sleeve. The plugs 30 are preferably formed in the same elastomeric material as the sleeves 2, and sized with a diameter slightly greater than the inner diameter of the sleeves 2, so that the plug 30 are retained once inserted in the open ends 209 of the sleeves 2. The plugs may be between 10 mm and 120 mm long, and in one embodiment of the invention are cylindrical rods about 90 mm long.

The open ends 207 of the sleeves 202 are formed with a V-shape profile, so that a central sleeve 202' is longer than adjacent sleeves. This provides the benefit that drum sticks 15 of approximately equal length will project from the holder 201 with a similar V-shape profile, making it easier to identify and select a particular drum stick 15 from the drum stick holder 201.

In an alternative embodiment the V-shaped arrangement is invented, that is, at least one middle sleeve projects inwards of adjacent outermore sleeves relative to an insertion direction for drum sticks.

FIG. 6 is a perspective view of the drum stick holder of FIG. 1, being used to hold five drum sticks 15, and being removably mounted atop a dedicated stand 40 which engages with a central sleeve 2'. In alternative embodiments (not shown) the holder may be mounted using any of the other sleeves. The drum stick holder 1 may be rotated about an axis 42 of the stand as desired by a user of the holder 1.

When, as in the first embodiment 1, the drum stick holder has sleeves 2 with two open ends 7, 9 to which free access may be had, the drum stick holder may be used to hold two drum sticks 15, one in each open end 7, 9 of drum stick holder 1. Because each drum stick 15 is held resiliently by the elastomeric bodies 4 of the sleeves 2, at least some of the drum sticks may project horizontally or even vertically downwards yet still be retained securely by the holder 1.

The use of elastomeric material in the drum stick holders 1, 101, 201 described above provides a number of significant benefits. The drum stick holders are flexible, so that in the event of knocks, the holder is not damaged. The resilience of the material makes it easier to provide a secure fixing, for example to the drum itself, and there is no need to clamp the holder to a stand. The compliance of the holder makes it difficult to break or damage a stick, or to knock a stand over, if something catches on a stick. The elastomeric material also provides if needed a firm gripping hold on the drum stick so that the stick is not inadvertently knocked out of holder, yet a drum stick can still be pulled out easily when needed.

Figure 8:
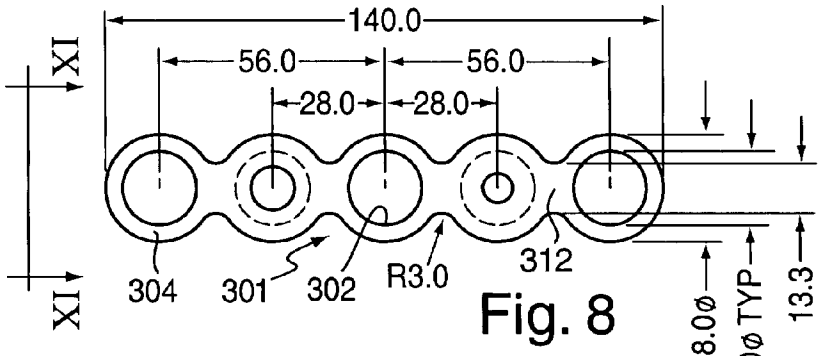
FIG. 8 is a bottom end view of the drum stick holder of FIG. 7, taken along the line VIII-VIII of FIG. 7.
Figure 7:
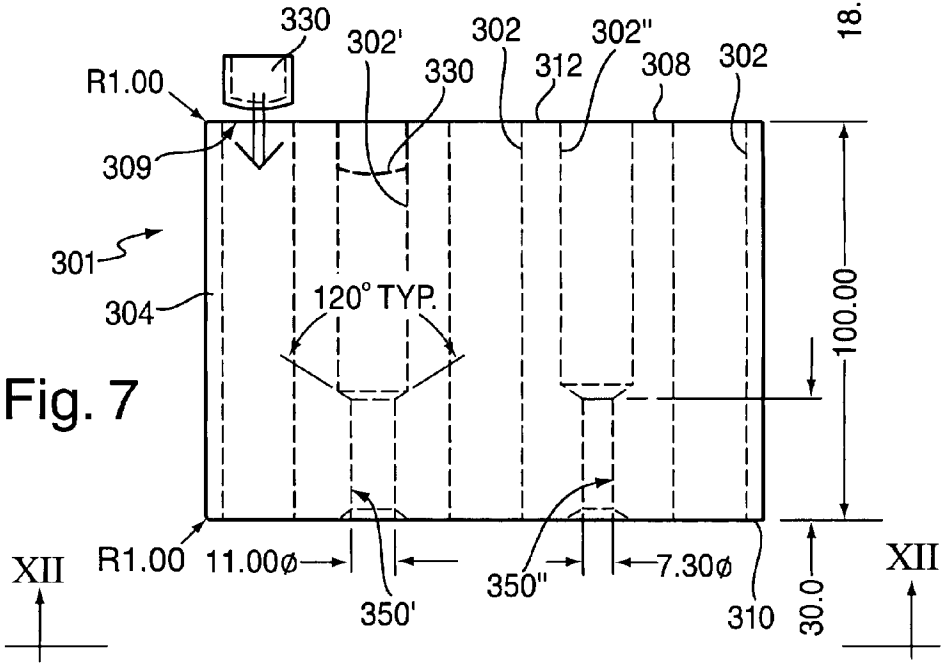
FIG. 7 is a side view of a drum stick holder according to a fourth embodiment of the invention, having five tubular sleeves, two of which are constricted at one end, formed in an elastomeric material.
Figure 9:
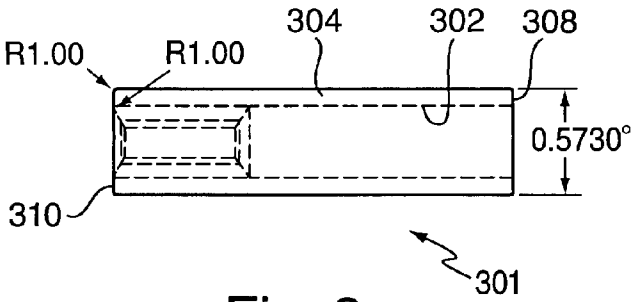
FIG. 9 is a side end view of the drum stick holder of FIG. 8, taken along the line IX-IX of FIG. 8.

FIGS. 7-9 show various views of a drum stick holder according to a fourth embodiment 301 of the invention, in which features similar to those of the first embodiment 1 are indicated by reference numerals incremented by 300. The holder 301 has five tubular sleeves 302 formed in an elastomeric material, two of which 302', 302" have a stepped internal diameter which therefore constricted at one end 350', 350". These constricted ends are suitable for engagement with a mount (not shown) having a matching outer diameter. The mount may be similar to those shown in FIGS. 2, 3 or 6, or any other type of mount suitable for use with percussion instruments.

The fourth embodiment differs from the first embodiment 1 in that the internal diameter is 18.5 mm, which is about 1 mm and 6 mm wider than a typical drum stick. In this case, the drum stick is fully inserted into the sleeve 302 and rests on a plug 330 closing one end of the sleeve.

Optionally, the constricted ends 350', 350" may be used to hold narrow diameter drum sticks and also percussion instrument keys which are used to adjust or tune a percussion instrument.

The holder 301 also differs in having non-planar webs 312 of material between adjacent sleeves 302.

One or more cylindrical plugs 330, about 17 mm long in the axial direction, are provided which may be inserted into open ends 309 of the sleeves 302 in order to close off an open end. The axial position of the plugs 330 may be adjusted to optimise the holder depth to sticks of different diameter so that narrow sticks do not wobble if placed in a sleeve which is too short. Fatter sticks may benefit from shorter sleeve depth as then the stick will be less likely to stick when retrieved.

FIGS. 7-9 show dimensions in millimetres and angles in degrees for one preferred version of the invention. The holder is formed in injection moulded silicone, and so as shown in FIG. 9 has a slight taper of 0.573° on the outer diameter to facilitate removal from an injection mould (not shown). External edges of the holder are radiused so that these edges do not dig into external objects.

Figure 10:
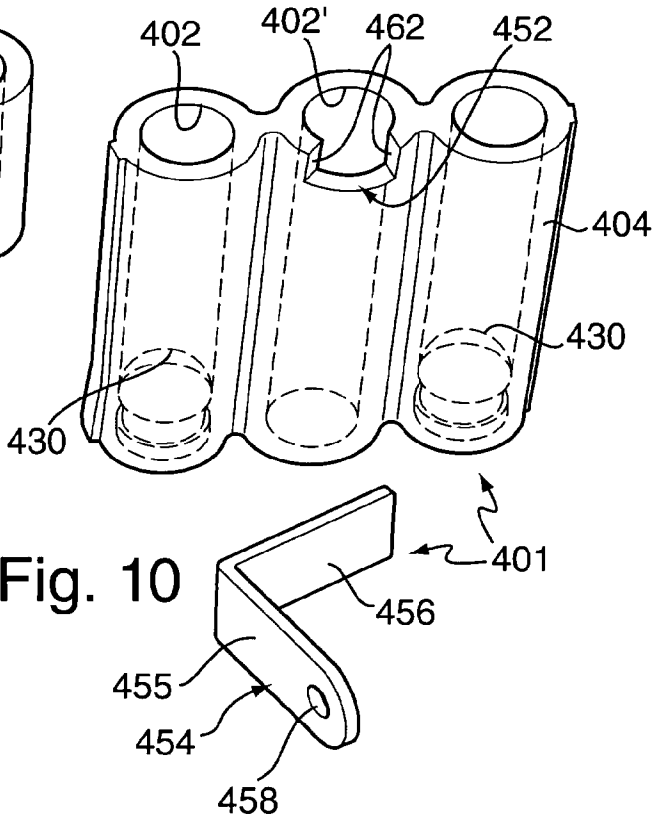
FIG. 10 is a perspective view of a drum stick holder according to a fifth embodiment of the invention, having three tubular sleeves formed in an elastomeric material, one of which has a radially extending slot for receiving and gripping an L-shaped bracket mount.

FIG. 10 is a perspective view of a drum stick holder according to a fifth embodiment 401 of the invention, in which features similar to those of the first embodiment 1 are indicated by reference numerals incremented by 400. The holder 401 has three tubular sleeves 402 formed in an elastomeric material, one of which 402' has a radially extending slot or rebate 452 for receiving and gripping an L-shaped bracket mount 454. The other two sleeves 402 are particularly convenient holders for a pair of drum sticks so that these are immediately at hand when a drummer returns to a drum kit. The bracket mount 454 has two planar arms 455,456 that extend at right angles and at equal distances from each other. One arm 455 has a through-hole 458 which may be used to connect this end of the bracket 454 to a percussion instrument, for example to a tensioning bolt at the perimeter of a drum (not shown). The other arm 456 is a plain tab.

The width of at least the tab-like arm 456 is equal to or slightly greater than the inner diameter of the sleeve 402' having the radially extending slot 452, so that this may be snugly inserted into this sleeve 402'. The other arm 454 then has a width equal to or slightly greater than that of the slot 452 so that this may be pressed into and retained by compliant side edges 462 of the slot 452.

One or more of the sleeves 402 may be closed by an inserted plug 430.

Figure 11:
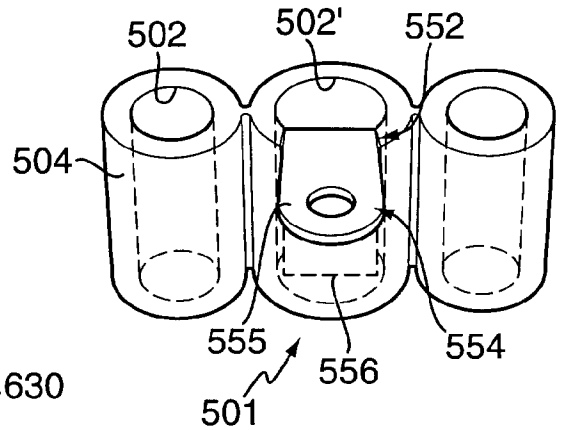
FIG. 11 is a perspective view of a drum stick holder according to a sixth embodiment of the invention, similar to that of FIG. 10, but having three short tubular sleeves, showing how the L-shaped bracket is lodged in the radially extending slot.

This arrangement is illustrated in FIG. 11, which shows a perspective view of a drum stick holder according to a sixth embodiment 501 of the invention, in which features similar to those of the first embodiment 1 are indicated by reference numerals incremented by 500. This holder is particularly suitable for holding tuning keys. Here, a bracket 554 similar to that 454 of FIG. 10, is shown seated in a slot 552 in a central sleeve 502' of the holder 501. One arm 555 of the bracket 554 extends at right angles to the plane defined by the axes of the tubular sleeves 502, while the tab-like other arm 556 is retained axially within the central sleeve 502'. As can be seen from the drawing, the tab-like arm 556 is slightly wider than the central sleeve 502' as circularly formed, thus causing this sleeve 502' to bulge laterally outwards into an oval shape.

Figure 12:
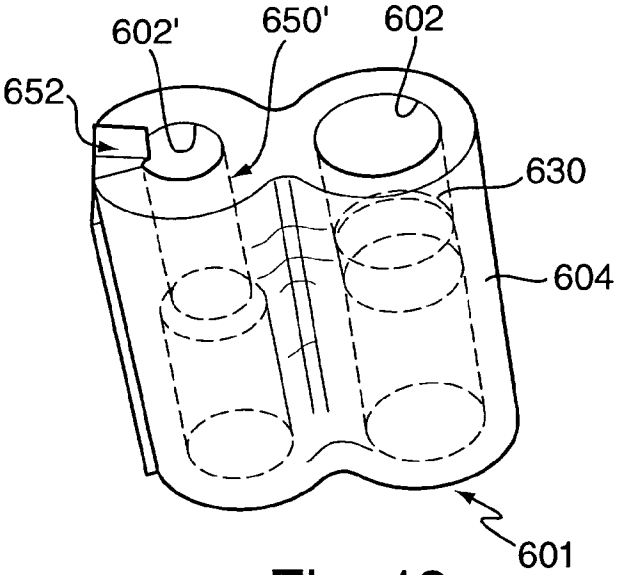
FIG. 12 is a perspective view of a drum stick holder according to a sixth embodiment of the invention, similar to that of FIG. 10, but having two long tubular sleeves, showing another type of radially extending slot.

FIG. 12 is a perspective view of a drum stick holder according to a sixth embodiment 601 of the invention, in which features similar to those of the first embodiment 1 are indicated by reference numerals incremented by 600. The holder 601 is similar to that of FIGS. 10 and 11, but has two long tubular sleeves 602. One or more of the sleeves 602 may be closed by an inserted plug 630.

One of the sleeves 602' has a constricted end 650' which also has a radially extending slot 652 for receiving an L-shaped bracket (not shown) as described above, except that here the slot 652 extends in the plane defined by the parallel tubular sleeves 602. Therefore, in this example of the invention, the sleeve 602 not having the slot would extend in line away from the mounting bracket, rather than transversely away from the mount.

The use of elastomeric material also makes the holder noiseless in use, which is particularly helpful in recording sessions. Exposed edges of the holder may be chamfered.

Only the tip end or butt end of the drum stick need be held or gripped by the elastomeric material which is advantageous because more of the drum stick will protrude from the holder, making it easier to get hold of a drum stick, and to find a place on a drum kit on which to mount the holder in such a way that the drum sticks project high enough to enable the drum sticks to be easily reached by a drummer or percussionist.

Depending on the relative diameters of a drum stick and holder, the holder may also be used to hold a stick with either the tip end or the butt end engaged in a holder sleeve. A holder can also be designed with a range of sleeve diameters, and with either fixed or adjustable plugs defining one end of a sleeve so that sticks of different lengths can be conveniently held within the sleeve, or so that a stick protrudes from a sleeve by a desired convenient amount.

As will be appreciated from the above discussion, the invention may be used with multiple different mounting options to a drum kit, thereby permitting a user to mount drum sticks at an optimum position and angle according to the percussionist's personal kit layout and playing style. This, together with the inherent separation between sticks provided by the invention, permits a user to select a stick swiftly and reliably while playing drums or other percussion instruments.

The mounts described above are both inexpensive and quick to set up and remove, as may be necessary when packing and unpacking a drum kit or other percussion instruments. If the holder is left in place when not in use or when the instruments are packed for removal, the flexible and compliant nature of the holder will protect both the holder and the percussion instrument from inadvertent knocks.

The holder is preferably moulded in a high quality silicone material, which provides excellent durability and which may be easily cleaned of any dirt or residue using common cleaning agents without the risk of any change in mechanical properties or damage to the holder.

The holder according to the invention is also of a compact and lightweight design, making it an easy accessory to use with percussion instruments, which may need to be moved about or packed away from time to time. The design of the holder may also be varied to suit any type of percussion instrument, and may be moulded in a wide range of colours or finishes, including transparent, translucent, solid coloured, glow-in-the-dark, wood effect, light sensitive and heat sensitive materials, and metallic coloured.

The holder according to the invention also provides the benefit of one-piece or unitary construction for all of the adjoining sleeves, not needing, for example, any other backing material, reinforcement or structural support to hold each of the sleeves mechanically together. Essentially, this is because the high grade silicone material is flexible yet rigid enough not to need any additional reinforcement and because each of the tubular sleeves extends integrally or continuously around the radius of each sleeve, with no breaks or gaps in the tubular walls of each sleeve.

The drum stick holder may also be used to hold other percussion items that a drummer needs to use, such a keys for the drum kit. Such keys are, of course, shorter than a typical drum stick, and so shorter sleeves, for example 40 mm long, may be provided for such items as part of the drum stick holder.

The drum stick holder according to the invention therefore provides a number of significant benefits in use, in addition to being well suited to volume mass production at an affordable price.

It is to be recognized that various alterations, modifications, and/or additions may be introduced into the constructions and arrangements of parts described above without departing from the spirit or scope of the present invention, as defined by the appended claims.

The invention claimed is:

1. A drum stick holder, comprising an elastomeric material body, the body comprising a plurality of substantially parallel tubular sleeves, each sleeve extending between opposite sleeve ends and being joined to at least one adjacent sleeve by an interposed web of the elastomeric material and having at one or both of said ends an entrance with dimensions suitable for receiving just one drum stick, wherein at least one of the sleeves has an entrance at both of said ends and each sleeve is formed from an integral tube of elastomeric material that extends fully around a longitudinal axis of the sleeve, wherein: each entrance is fully open and said plurality of sleeves are arranged in a single row so that each sleeve may hold a drum stick inserted into the entrance at one or both of said ends of said sleeve.

2. A drum stick holder as claimed in claim 1, in which each of said sleeves has a longitudinal axis, and each of said axes lies in a common plane that extends through each sleeve.

3. A drum stick holder as claimed in claim 2, in which each sleeve is joined to an adjacent sleeve by means of a web of elastomeric material.

4. A drum stick holder as claimed in claim 3, in which the or each web of material lies in said plane in which said longitudinal axes lie.

5. A drum stick holder as claimed in claim 1, in which all of the sleeves have an entrance at both ends.

6. A drum stick holder as claimed in claim 1, in which The holder comprises one or more plugs that may be removably inserted into one or more corresponding sleeves to close off one end of said sleeve(s).

7. A drum stick holder as claimed in claim 5, in which at least one plug when inserted into a sleeve is adjustable along an axial direction to vary the depth of said sleeve.

8. A drum stick holder as claimed in claim 1, in which each of said body, sleeves, and web is integrally moulded as an extrusion.

9. A drum stick holder as claimed in claim 1, in which at least one sleeve is tapered internally to aid insertion of a drum stick into the sleeve and to grip the drum stick once inserted into the sleeve.

10. A drum stick holder as claimed in claim 1, in which a tear strip separates at least two adjacent sleeves so that at least one sleeve may be torn from the drum stick holder to reduce the number of sleeves.

11. A drum stick holder as claimed in claim 1, in which each sleeve has an annular cross-section.

12. A drum stick holder as claimed in claim 1, comprising additionally a mount for mounting the holder to a drum kit, the arrangement being such that each sleeve is supported by the mount.

13. A drum stick holder as claimed in claim 12, in which the mount is affixed to one end of at least one sleeve.

14. A drum stick holder as claimed in claim 12, in which the mount includes at least one projection which locates in at least one corresponding sleeve in order to secure the mount to the sleeves.

15. A drum stick holder as claimed in claim 12, in which the mount is a bracket seated in a radially extending slot at an end of a sleeve.

16. A drum stick holder as claimed in claim 1, in which one or more sleeves has a stepped internal diameter.

17. A drum stick holder as claimed in claim 1, in which there are at least three sleeves, at least one middle sleeve projecting forwards of adjacent outermore sleeves relative to an insertion direction for drum sticks.

18. A drum stick holder as claimed in claim 1, in which there are at least three sleeves, at least one middle sleeve projecting inwards of adjacent outermore sleeves relative to an insertion direction for drum sticks.

19. A drum stick holder as claimed in claim 17, in which the open ends of said sleeves are arranged in a V-pattern.

20. An accessory for a percussion instrument comprising a drum stick holder and at least one drum stick, said holder having at least one elastomeric sleeve and the drum stick being inserted partially into said sleeve to expand at least to some degree the sleeve so that the sleeve thereby holds or grips the drum stick, wherein the drum stick holder comprises a elastomeric material body comprising a plurality of substantially parallel tubular sleeves, each sleeve extending between opposite sleeve ends and being joined to at least one adjacent sleeve by an interposed web of the elastomeric material and having at one or both of said ends an entrance with dimensions suitable for receiving just one drum stick, wherein at least one of the sleeves has an entrance at both of said ends and each sleeve is formed from an integral tube of elastomeric material that extends fully around a longitudinal axis of the sleeve and each entrance is fully open and said plurality of sleeves are arranged in a single row so that each sleeve may hold a drum stick inserted into the entrance of said sleeve.

* * * * *